US011213840B2

(12) United States Patent
Owens et al.

(10) Patent No.: US 11,213,840 B2
(45) Date of Patent: Jan. 4, 2022

(54) MIXER DESIGN FOR A PLURAL COMPONENT SYSTEM

(71) Applicant: Wagner Spray Tech Corporation, Plymouth, MN (US)

(72) Inventors: Austin W. Owens, Wales, WI (US); Justin T. Steffl, New Ulm, MN (US); Adam S. Troness, Dellwood, MN (US); Mitchell S. Kelley, Naperville, IL (US); David A. Cook, Pennock, MN (US); Jeffrey S. Jerdee, Brooklyn Park, MN (US); Jeshwanth D S Kundem, Minneapolis, MN (US); Shawn C. Johnson, Milaca, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 0 days.

(21) Appl. No.: 15/963,390

(22) Filed: Apr. 26, 2018

(65) Prior Publication Data

US 2018/0353982 A1 Dec. 13, 2018

Related U.S. Application Data

(60) Provisional application No. 62/492,669, filed on May 1, 2017.

(51) Int. Cl.
*B05B 7/04* (2006.01)
*B05B 7/12* (2006.01)
(Continued)

(52) U.S. Cl.
CPC ..... *B05B 7/1209* (2013.01); *B01F 3/0861* (2013.01); *B01F 5/0475* (2013.01); *B05B 7/0408* (2013.01)

(58) Field of Classification Search
CPC ... B05B 7/0408; B05B 7/1209; B01F 3/0681; B01F 3/0865; B01F 5/0475; B01F 5/0256; B01F 2005/0034; B29B 7/7435
(Continued)

(56) References Cited

U.S. PATENT DOCUMENTS 2,890,836 A * 6/1959 Salensky ..... B05B 7/32 239/117
3,263,928 A * 8/1966 Gusmer ..... B05C 17/015 239/123
(Continued)

FOREIGN PATENT DOCUMENTS

AT 43812 B 8/1910
CN 203076149 U 7/2013
(Continued)

OTHER PUBLICATIONS

International Search Report and Written Opinion for International Patent Application No. PCT/US2018/030130 dated Aug. 14, 2018, 17 pages.
(Continued)

*Primary Examiner* — Joseph A Greenlund
(74) *Attorney, Agent, or Firm* — Christopher J. Volkmann; Kelly, Holt & Christenson, PLLC

(57) ABSTRACT

A mixer for a plural component spray gun is presented. The mixer has a mixer body comprising a mixing chamber with an outlet. The mixer also has a first fluid component inlet, coupled to a first fluid conduit, configured to introduce a first fluid component into the mixing chamber. The mixer also has a second fluid component inlet, coupled to a second fluid conduit, configured to introduce a second fluid component into the mixing chamber. The first and second fluid component inlets are offset with respect to a centerline of the mixing chamber and positioned such that a first fluid flow
(Continued)

from the first inlet is directed toward the outlet, and a second fluid flow from the second inlet is directed toward the outlet.

19 Claims, 18 Drawing Sheets

(51) Int. Cl.
*B01F 5/04* (2006.01)
*B01F 3/08* (2006.01)

(58) Field of Classification Search
USPC ..... 239/414, 433
See application file for complete search history.

(56) References Cited

U.S. PATENT DOCUMENTS 3,437,273 A * 4/1969 Hagfors ..... B05B 7/0408 239/414
3,876,145 A * 4/1975 Gusmer ..... B05B 15/55 239/112
3,917,756 A * 11/1975 Rice ..... B01F 13/00 261/18.1
4,453,670 A * 6/1984 Sirovy ..... B05B 7/1209 239/117
4,471,887 A * 9/1984 Decker ..... B29B 7/7678 222/135
4,550,863 A * 11/1985 Farrey ..... B05C 17/00553 222/145.8
4,708,292 A * 11/1987 Gammons ..... B05B 7/0018 239/414
5,299,740 A * 4/1994 Bert ..... B05B 15/5225 239/117
6,328,229 B1 * 12/2001 Duronio ..... B01F 5/0057 222/145.5
7,527,172 B2 * 5/2009 McMichael ..... B29B 7/761 222/145.5
7,552,847 B2 * 6/2009 Hayduk ..... B29B 7/7684 222/145.2
7,559,440 B2 * 7/2009 Rueschhoff ..... B05B 1/3066 222/145.5
7,651,035 B2 * 1/2010 van der Heijden ..... B01F 15/0226 239/1
8,931,715 B2 * 1/2015 Courier ..... B29B 7/7452 239/112
9,038,929 B1 * 5/2015 Commette ..... B05B 7/2497 239/526
2002/0113146 A1 * 8/2002 Scherer ..... B05B 7/0408 239/525
2004/0124268 A1 * 7/2004 Frazier ..... B01F 5/0256 239/398
2005/0194471 A1 * 9/2005 Anderson ..... B05B 1/042 239/597
2006/0109738 A1 * 5/2006 Buchholz ..... B01F 5/0077 366/162.4
2007/0034716 A1 * 2/2007 Zittel ..... B05B 7/1272 239/296
2008/0257979 A1 * 10/2008 Crawford ..... B29B 7/7447 239/75
2010/0308134 A1 * 12/2010 Bunnell ..... B05B 7/0408 239/398
2011/0011950 A1 * 1/2011 Walter ..... B29B 7/7438 239/398
2013/0015262 A1 * 1/2013 Monchamp ..... B29B 7/7647 239/61
2018/0297045 A1 * 10/2018 Eletto ..... B05B 12/002
2018/0353982 A1 * 12/2018 Owens ..... B01F 5/0475

FOREIGN PATENT DOCUMENTS

CN 105689169 A 6/2016
JP H10-315226 A 12/1998
JP 2006-511343 A 4/2006
KR 101200952 B1 11/2012
RU 2009710 C1 * 3/1994 ..... B01F 5/0062
RU 2009710 C1 3/1994

OTHER PUBLICATIONS

International Preliminary Report on Patentability for International Patent Application No. PCT/US2018/030130, dated: Nov. 14, 2019, date of filing: Apr. 30, 2018, 14 pages.
First Office Action for Chinese Patent Application No. 201880028989.3 dated Oct. 12, 2020, 17 pages with English Translation.
Extended Search Report for European Patent Application No. 18794272.7 dated Dec. 16, 2020, 8 pages.
Second Office Action for Chinese Patent Application No. 201880028989.3 dated Jun. 17, 2021, 12 pages with English Translation.

* cited by examiner

MIXER DESIGN FOR A PLURAL COMPONENT SYSTEM

CROSS-REFERENCE OF RELATED APPLICATIONS

The present application is based on and claims the benefit of U.S. Provisional Patent Application Ser. No. 62,492,669 filed May 1, 2017, the content of which application is hereby incorporated by reference in its entirety.

BACKGROUND

Plural component systems mix two or more fluids and apply the mixture to an application site. Plural component systems are often used to spray two components that, when mixed, react and cure on a surface. One particular usage for plural component systems is to generate a foam through the reaction of an A component and a B component that, when sprayed, react and cure quickly. Proper foam generation requires sufficient fluid delivery, sufficient chemical mixing, and sufficient fluid dispersal.

A plural component spray gun has three main components: a coupling block, a gun block, and a gun handle. The coupling block facilitates the two plural components entering a mixer, for example through an A-chemical or and a B-chemical port. The gun block includes filters, side seals, the mixer, and a fluid spray tip. The gun handle includes an air purge supply, a trigger mechanism, and an attachment to the gun block.

SUMMARY

A mixer for a plural component spray gun is presented. The mixer has a first fluid component inlet configured to introduce a first fluid component into the mixer. The mixer also has a second fluid component inlet configured to introduce a second fluid component into the mixer. The first and second fluid component inlets are offset with respect to a centerline of the mixer and positioned such that a first fluid flow from the first inlet is directed away from the second inlet, and a second fluid flow from the second inlet is directed away from the first inlet.

DETAILED DESCRIPTION OF ILLUSTRATIVE EMBODIMENTS

A plural component spray gun receives at least two fluids that are reactively combined within a mixer, and then dispensed. The mixer receives each of the two fluids through a separate inlet. The mixer facilitates mixing of the plural components from their respective inlets, and emits, through an outlet, a product which is then sprayed or otherwise provided at an outlet. The mixer is responsible for effective mixing of the two components, for example a liquid component A and a liquid component B. Components A and B, when cured, can create a plurality of different materials, for example thermal insulation, protective coating, etc.

Some important process variables for plural component mixing and spraying are fluid delivery, fluid dispersal and chemical mixing. Fluid delivery is affected by flow rate control and filtering. Chemical mixing is affected by reducing jetting and reducing back pressure. Fluid dispersal is affected by spray pattern, which, in turn, can be affected by the tip geometry and/or size. Some embodiments described herein utilize a spray tip with a cat-eye outlet. However, embodiments described herein may also be used with any other suitable outlet and/or internal geometry.

Components A and B are each pumped into a plural component spray gun mixer through two separate entry points in order to reduce the risk of a crossover event, e.g. component A backflowing into a fluid line for component B and reacting within the component B fluid line. Crossover events can result in a plural component gun becoming unusable. Chemical mixing of components A and B can be improved by reducing jetting, and by reducing back pressure. Jetting can be reduced by modifying an orifice offset between entry points for components A and B. Back pressure can be reduced by modifying an orifice angle at which components A and B enter the mixer.

Figure 1B:
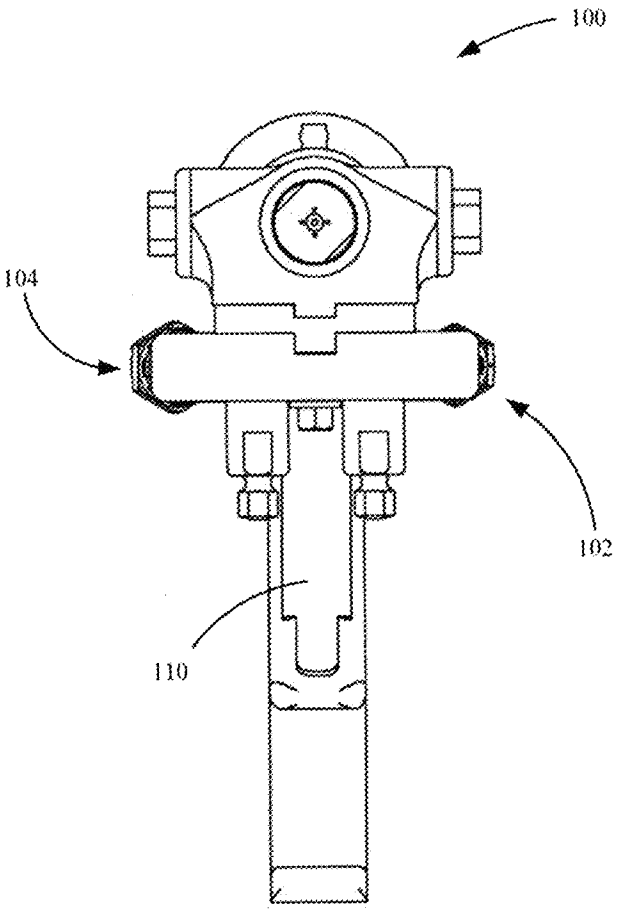
FIGS. 1A-1C are diagrammatic side elevation, front elevation and exploded perspective views, respectively of a plural component spray gun in which embodiments of the present invention are particularly useful.
Figure 1A:
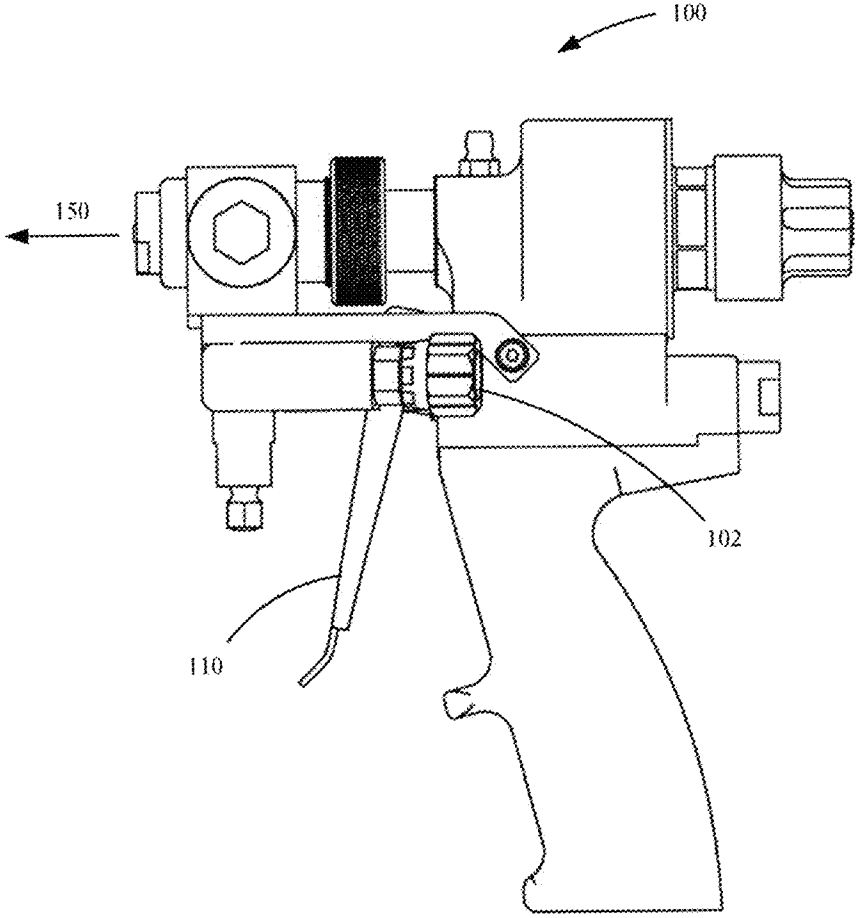
Figure 1C:
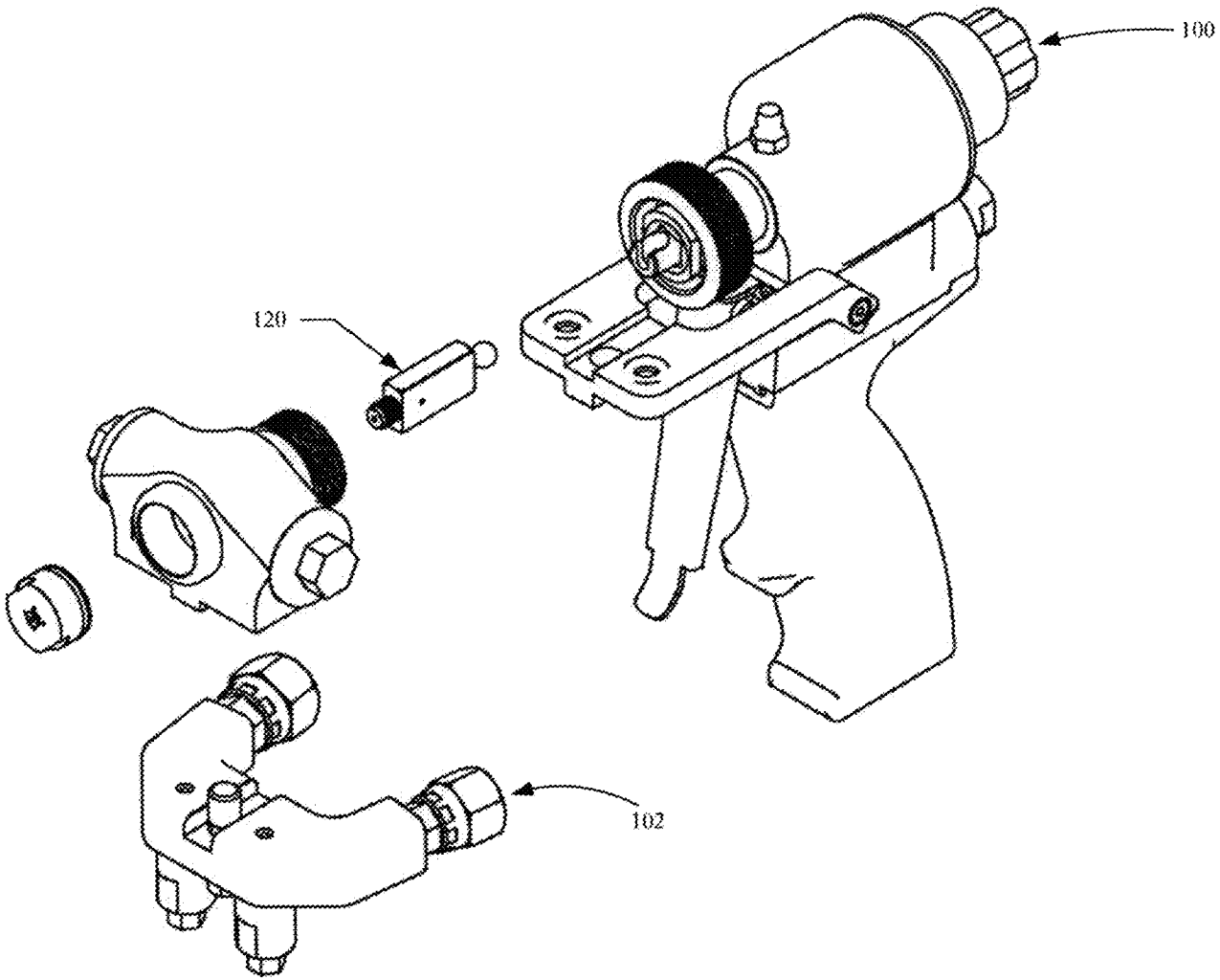

FIGS. 1A-1C illustrate plural component spray gun 100 in which embodiments of the present invention may be useful. Spray gun 100 is configured to spray a mixed fluid through outlet 150, when trigger 110 is actuated. Fluid components enter spray gun 100 through inlets 102 and 104 (shown in FIG. 1B). For example, component A may enter through inlet 102, and component B may enter through inlet 104.

FIG. 1C illustrates an exploded view of a plural component gun 100 illustrating a position of mixer 120 within spray gun 100. Mixer 120 received incoming components A and B from inlets 102, 104, respectively.

Figure 2:
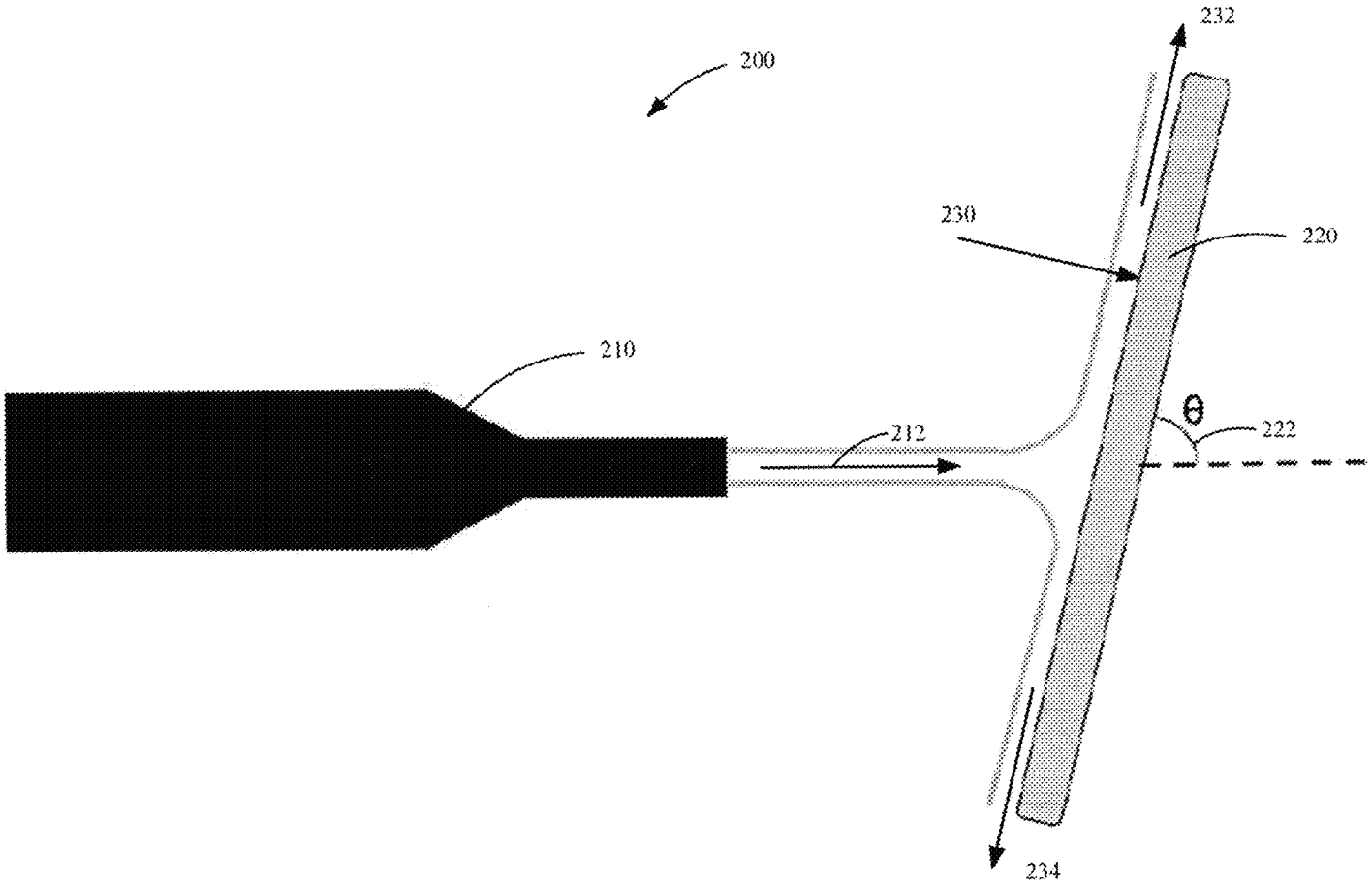
FIG. 2 illustrates a diagrammatic view of a fluid being applied to a wall.

FIG. 2 illustrates a diagrammatic view of a fluid being applied to a surface. Using Bernoulli's principle and momentum conservation, the normal force exerted on the wall and flow rates can be derived using equations 1-3 presented below.

$$F_n = pAV^2 \sin\theta \quad (1)$$

$$Q_1 = 1/2Q(1+\cos\theta) \quad (2)$$

$$Q_2 = 1/2Q(1-\cos\theta) \quad (3)$$

In Equations 1-3, $F_n$ is normal force 230, volumetric flow rates Q, Q1, and Q2 correspond, respectively, to flow rates 212, 232, and 234. A is the area of the nozzle, V is the velocity at the nozzle outlet, and θ is angle 222 of inclined wall 220, or the impingement angle.

Using Equation 1 it is determined that normal force 230 is maximum when the impingement angle 222 is 90°. Impinging the jet at an angle can decrease the normal force acting on the wall, which in turn, decreases the force. Flow rates 232 and 234 are also dependent on angle 222. In a scenario where angle 222 is not equal to 90°, the fluid has a higher tendency to move in a first direction as opposed to a second direction, for example, flow rate 232 is greater than flow rate 234.

As illustrated using Equations 1-3, in a first case scenario, a 90° impingement angle for an incoming component A, with respect to the inlet for component B may result in a higher back pressure, which may distribute the flow equally on both sides of a mixer. Such an equal distribution can present a disadvantage as there is only one outlet for most mixer designs. Fluid particles are diverted opposite in direction to the outlet, which restrict flow coming into the mixer. In turn, this requires more pressure to reverse the flow back towards the outlet. Since the mix chamber walls are curved, the fluid particles may have a tendency to move axially without bouncing back toward the inlet, as compared to a vertical wall.

In a second scenario, the fluid particles from liquid components A and B come to a complete rest when impinging on each other in the vicinity of their intersection within the mixer. The fluid particles may then have to be accelerated to gain axial velocity along the mixer, which affects the pressure required. Having a higher offset between inlets would decrease the impingement of the fluid components on each other, such that the pressure is solely through impingement off the chamber wall. However, having the flows of liquid components A and B impinging at each other does ensure efficient mixing.

Aside from the first and second case scenarios presented above, when the pressures at the orifices are varied by a higher amount, liquid from one inlet (for example, component A inlet) is at a higher risk of flowing into the opposite inlet (for example, component B inlet), instead of exiting, through the outlet. Such a scenario creates a crossover event, where the liquid components react and cure internally within the spray gun. In many cases, a spray gun that experienced a crossover event is no longer usable. It is desired, therefore, to improve efficiency without increasing the risk of crossover. At least some of the embodiments described herein achieve such improvements.

Figure 3A:
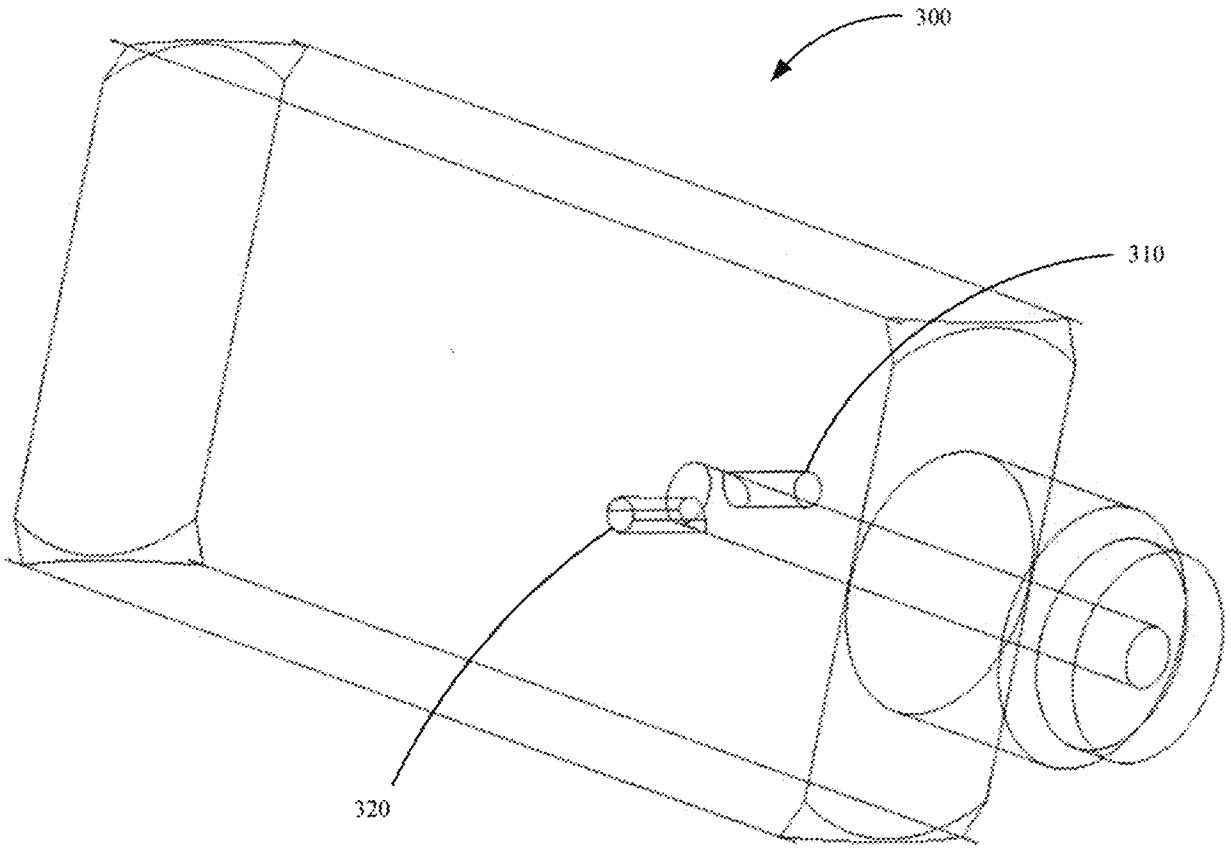
FIGS. 3A and 3B illustrate a known mixer design.
Figure 3B:
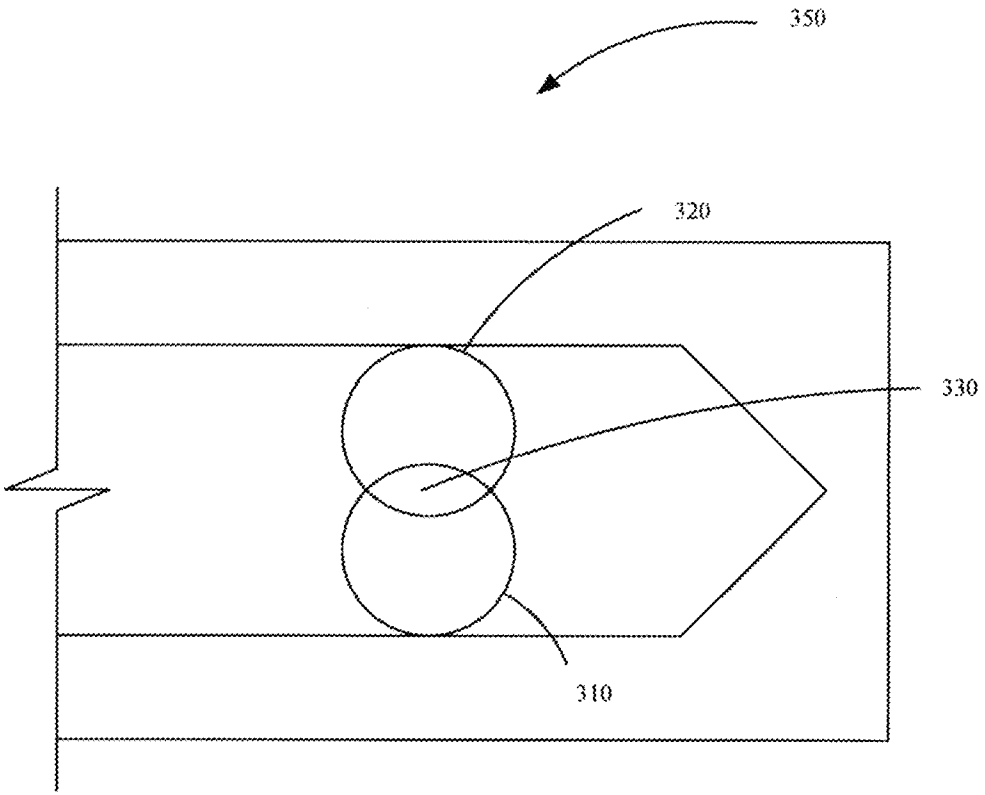

FIGS. 3A and 3B illustrate a known mixer design. For example, FIG. 3A illustrates a mixer available from Polyurethane Machinery Corporation, headquartered in Lakewood, N.J. (hereinafter referred to as "the PMC chamber"). The PMC chamber illustrated in FIG. 3A is a standard 00 mix chamber and 00 tip configured to combine liquid components A and B in mixer 300 using two inlet apertures 310 and 320 arranged to have an offset of 0.010 inches from their respective centerlines (as illustrated in FIG. 3A). A portion of liquid component A impinges on the wall of mixer 300 while the rest impinges on liquid component B. Liquid component B behaves similarly. FIG. 3B illustrates a diagrammatic cross sectional view 350 of mixer 300, illustrating the overlap 330 between caused by offset centerlines between inlets 310 and 320.

Several different design requirements are important to consider for a mixer. In addition to reducing crossover events, it is also desired to maintain or improve efficiency of fluid mixing within the mixer. Additionally, a functional spray pattern must be maintained by the spray gun during operation. Ideally, the mixer will also be compatible with existing plural component spray gun technology, with minimal or no retrofitting. It is also desired to maintain or increase the flow rate of fluid through the mixer. At least some embodiments herein increase the robustness of current mixer designs and make the designs more resistant to crossover, which can be caused by pressure imbalances between the two fluid entering the mixer. At least some embodiments described herein change the angle of one or both fluid component inlets, with respect to the mixer from directly perpendicular to the side walls of the mixer to an angle towards the outlet. In one embodiment, the angle is about 10°. Embodiments described herein may also increase the separation between the mixer inlets of the two fluid components. These changes can reduce back pressure on the inlet orifices, reduce jetting of the fluids into the opposite side orifice, and facilitate proper mixing of the chemicals within the mixer under all potential pressure differential conditions.

FIGS. 4A-4H illustrate a comparison between a mixer in accordance with an embodiment of the present invention, and the mixer of FIGS. 3A and 3B. Mixer 400, illustrated in FIG. 4A, includes a mixer body that receives a first fluid inlet 410, and a second fluid inlet 420. As illustrated, fluid component inlets 410 and 420 are each angled at an orifice angle 412 and 422, respectively. In one embodiment, orifice angles 412 and 422 are about 10°. However, embodiments can be practiced with other angles, such as 5° to 20°. Additionally, as illustrated, the positioning of inlets 410 and 420 differs with respect to previous designs.

One advantage of an angled orifice is that it results in a lager axial (i.e. in the direction of the outlet) component of the fluid velocity when the two fluids components enter mixing chamber 400 through inlets 410 and 420. When the two fluids enter the mixing chamber on offset planes, voracity, or fluid rotation, is introduced, which improves the ability of the two fluids to mix and react. Angling orifices 410, 420 toward the outlet means that, as the fluid rotates in mixing chamber 400, there is less of an opportunity for it to circulate over to the opposing orifice and create a small recirculation zone that could be a trigger point for crossover in the event of a pressure loss on one side.

Figure 4A:
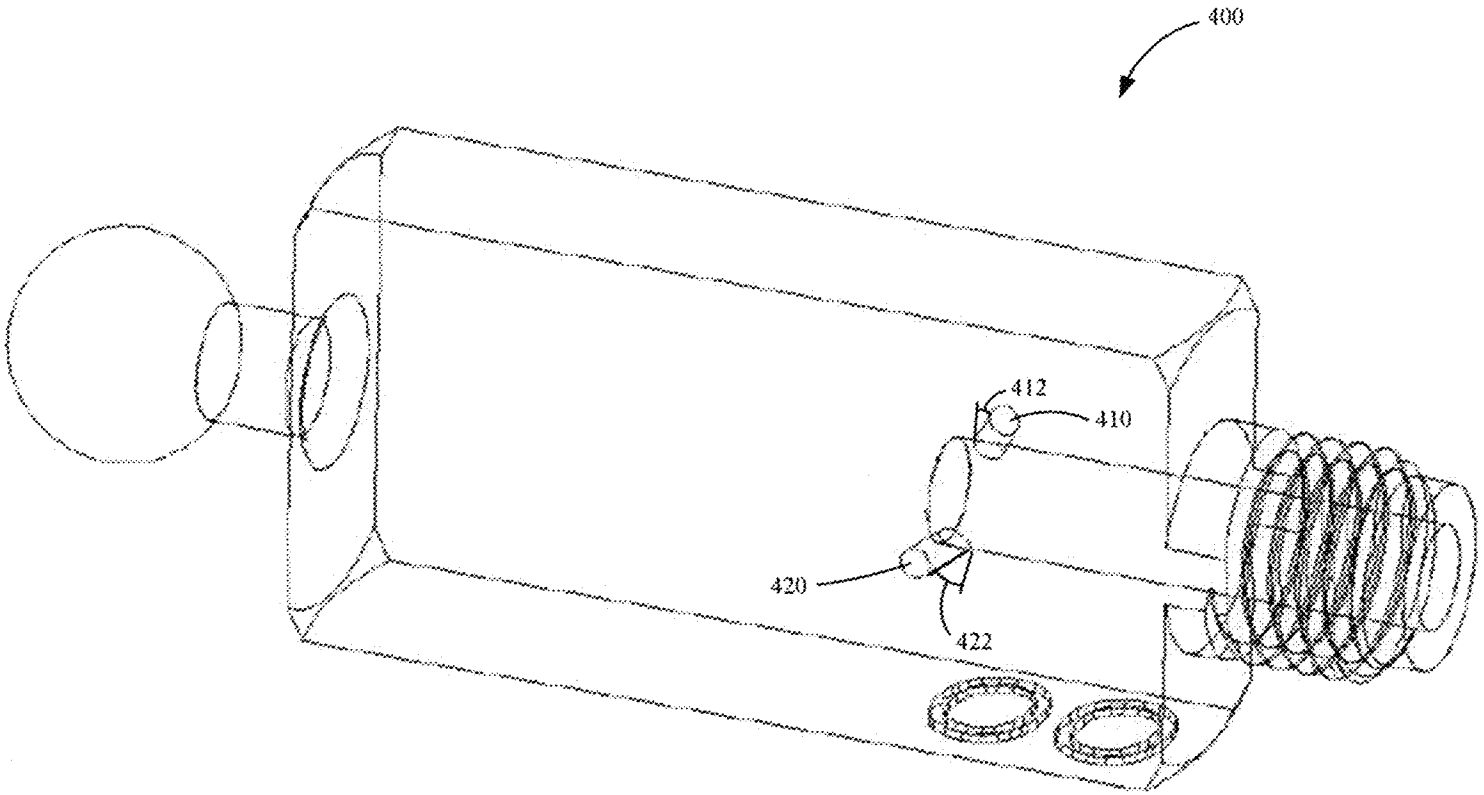
FIGS. 4A-4H illustrate a comparison between a mixer in accordance with an embodiment of the present invention, and the known mixer of FIGS. 3A and 3B.

Orifice location is an important consideration for a crossover resistant design, in that inlet orifices 410, 420 should be offset from the centerline of the mixing chamber. In the design of FIGS. 3A and 3B, each orifice is offset by 0.010 inches from the mix chamber center line, resulting in a total offset distance of 0.020 inches between the entry plane of the inlets. Since the inlet diameter of mixer 300 is 0.032 inches, each orifice can see a small section of the other orifice, which results in fluid jetting from one side to the other, as well as recirculation in the inlet region of each orifice. As illustrated in FIG. 4A, in one embodiment, the offset of inlet orifices 410, 420 is increased to 0.040 inches from the center line, or 0.080 inches total offset, and the inner diameter of mixer 400 is increased to allow for greater offset.

Figure 4B:
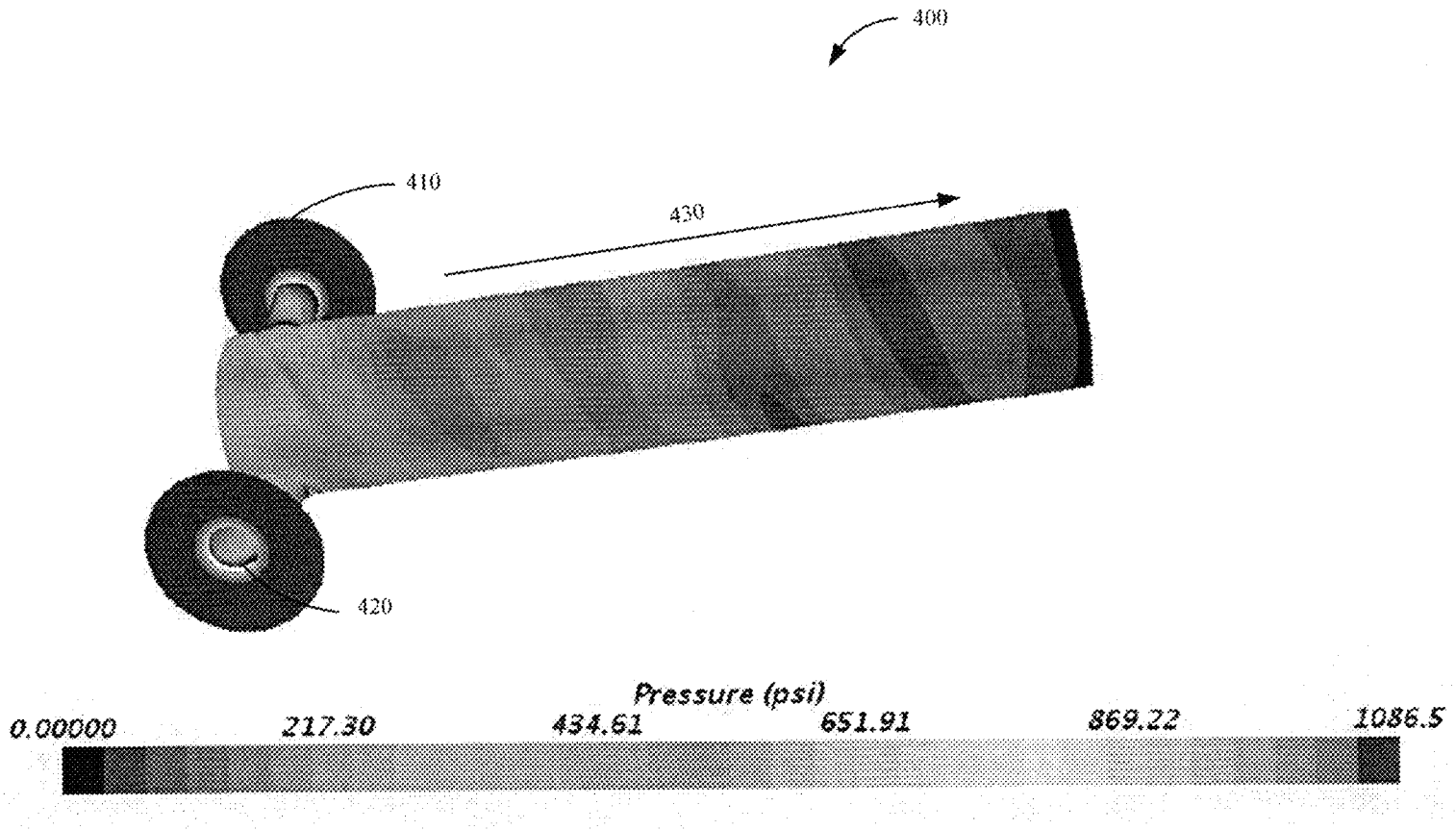
Figure 4C:
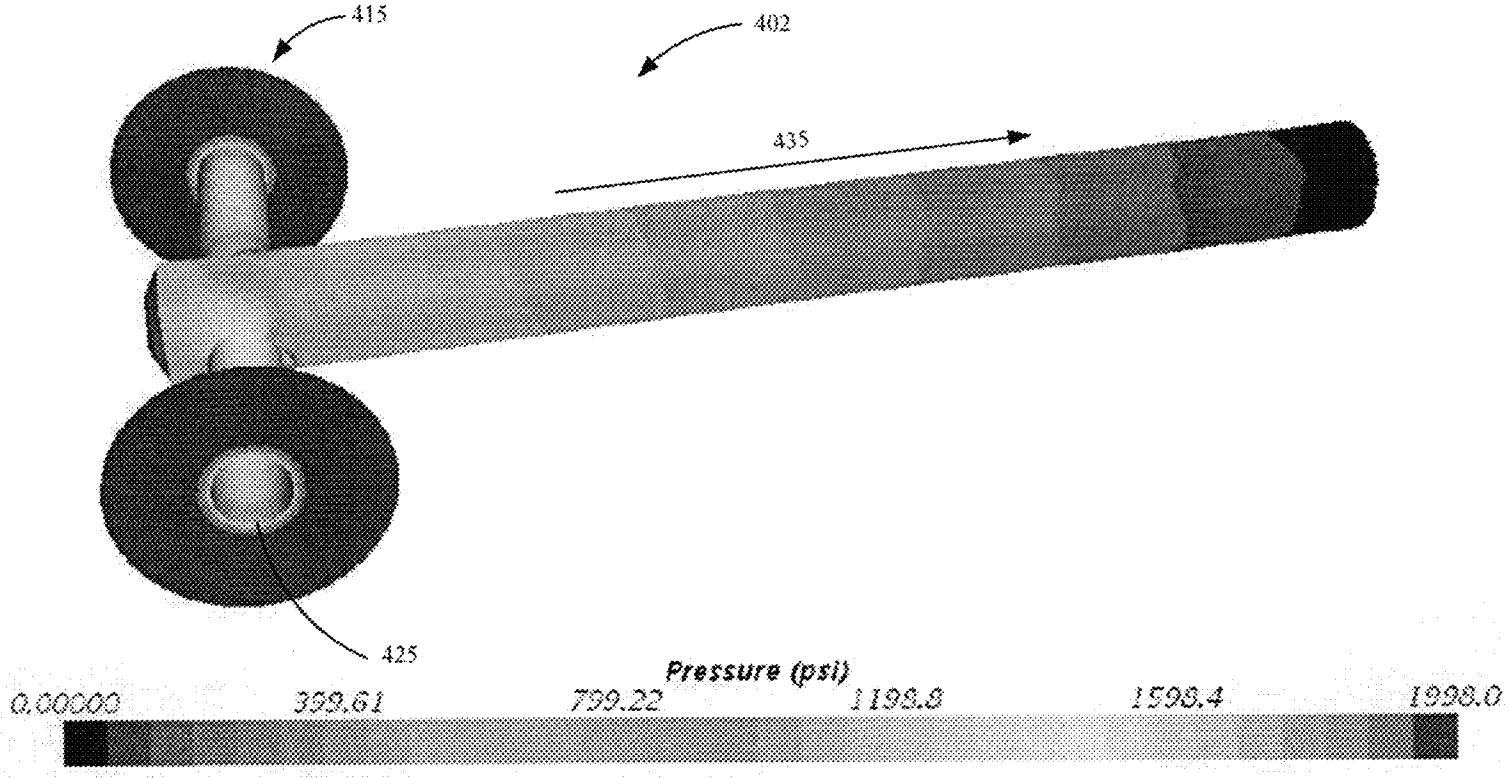

FIG. 4B is a computational fluid flow pressure diagram illustrating pressure contours experienced along a surface of mixer 400, in fluid flow direction 430. The pressure contours of FIG. 4B were obtained using water as a medium flowing through inlets 410 and 420. The flow rates on both inlets was kept constant at 0.6 gallons/minute (GPM). FIG. 4C shows a similar pressure contour using mixer 300, shown in FIGS. 3A and 3B. As illustrated in the comparison between FIGS. 4B and 4C, the pressure drop experienced using mixer 400 is lower than that using mixer 300, with the same maximum velocity experienced at 160 meters/second.

Figure 4D:
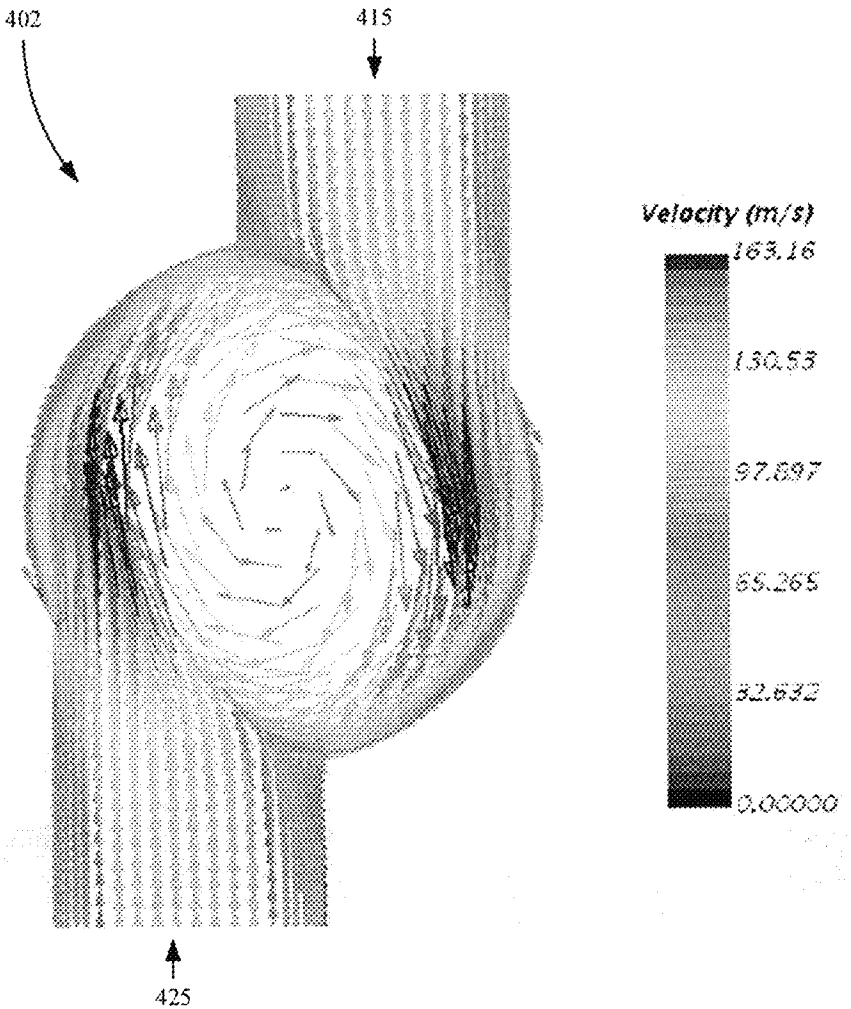
Figure 4E:
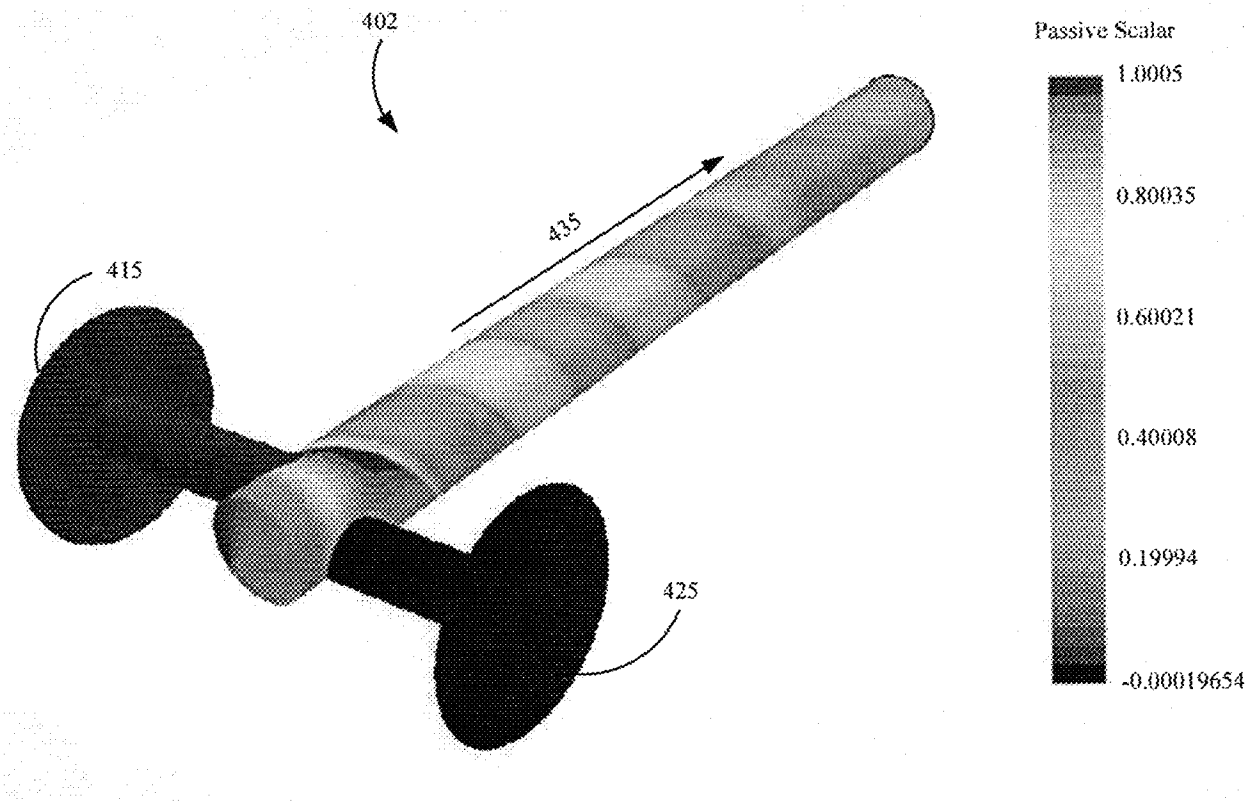
Figure 4F:
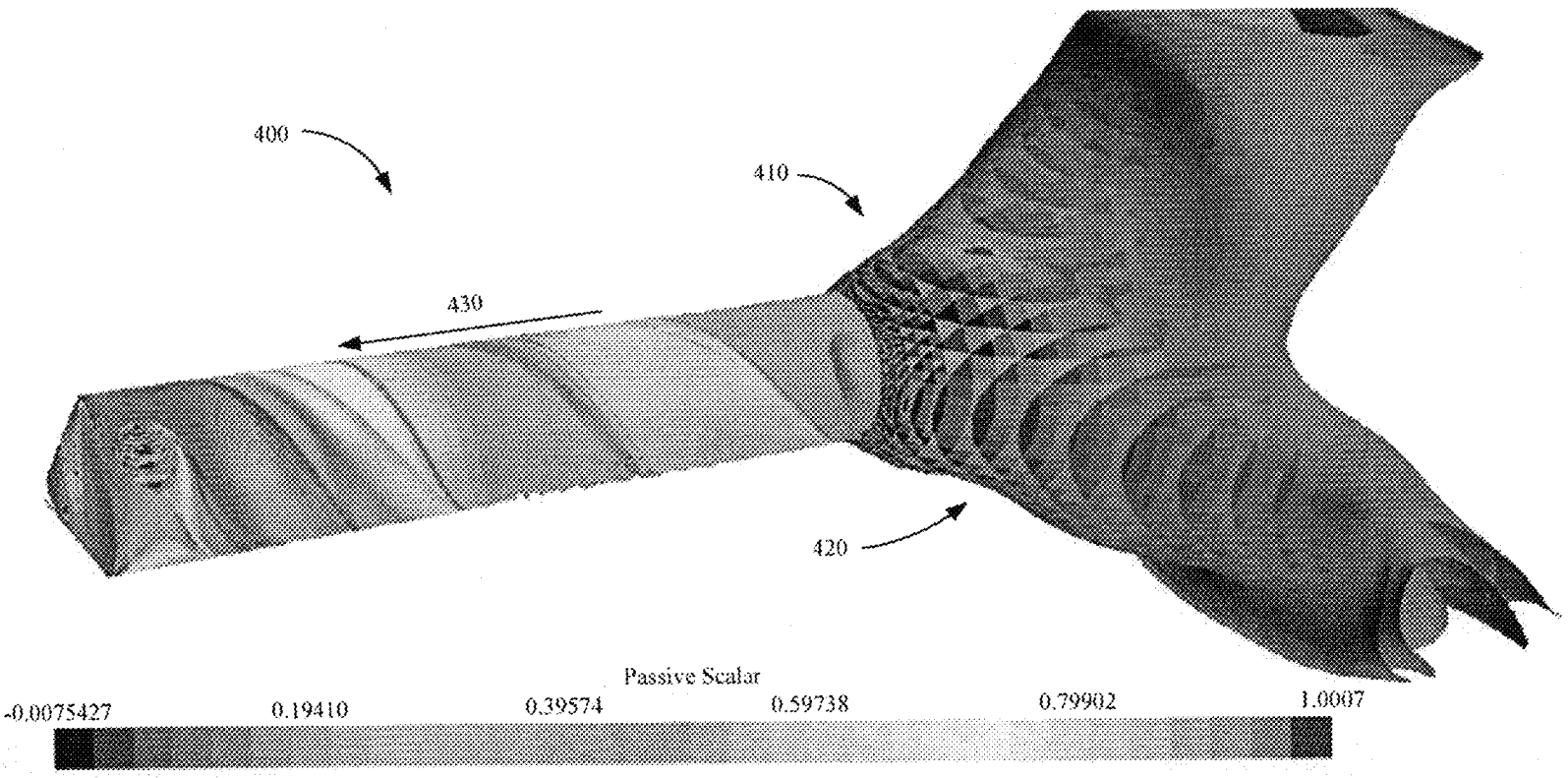
Figure 4G:
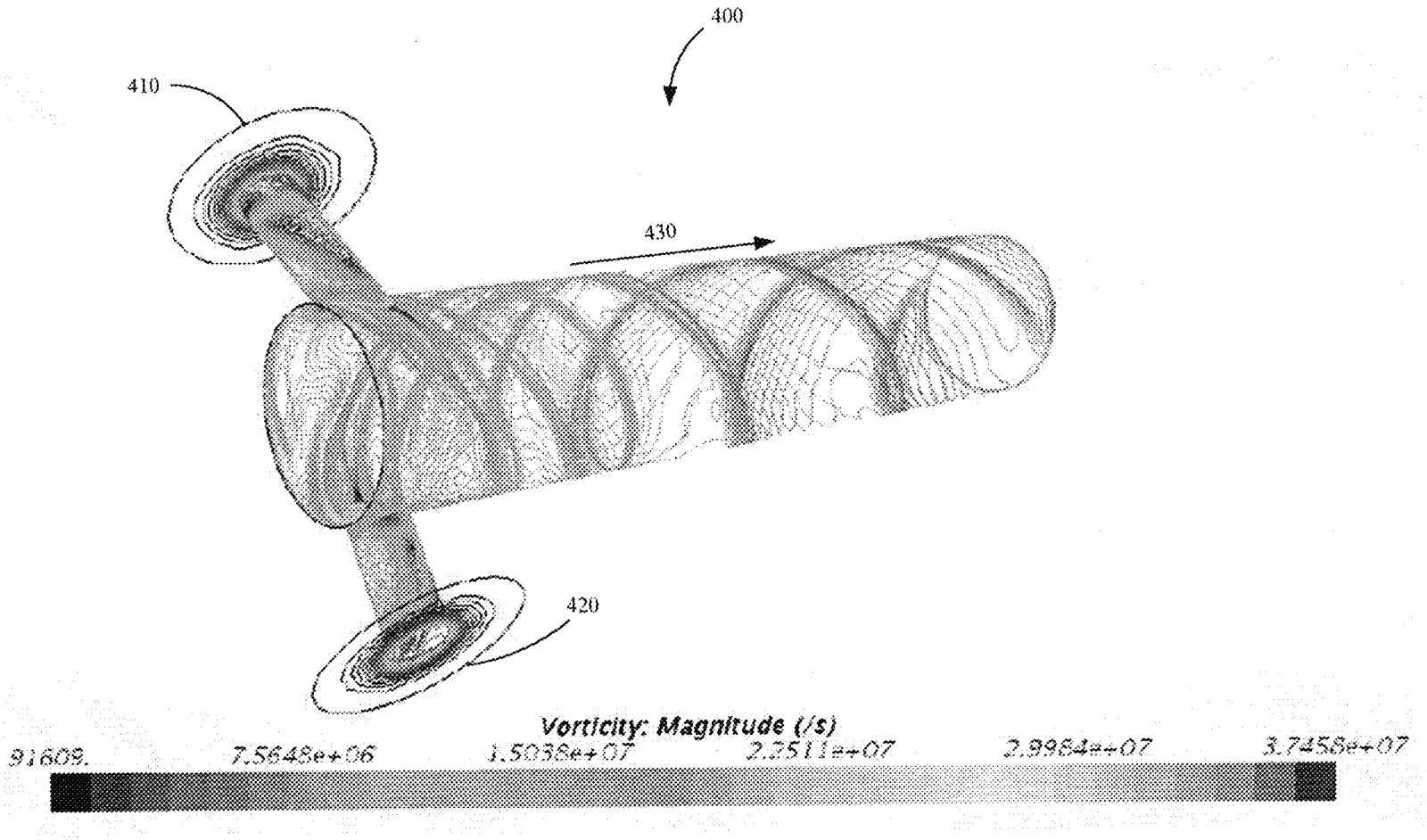

FIG. 4D illustrates velocity for mixer 300. As expected, almost zero velocity is experienced at the intersection of fluid jets 415 and 425. Instead, as one end of mixer 402 is blocked, fluid particles are directed away from the outlet and are bounced back. The force from these particles, combined with the inlet fluid pressure impinging on the circular wall, creates a whirling motion, as illustrated in FIG. 4E. In contrast, when liquid components A and B are inserted into a circular space tangentially, as illustrated in FIGS. 4F and 4G, they create an overall rotational motion. The swirling motion dissipates as the fluid flows along the length of mix chamber 400. This behavior is caused by a lower pressure region along axis 430. Fluid particles near the wall move inward into the low pressure region. The rotational motion is converted to axial motion along the length of mix chamber 400 as illustrated in FIG. 4F FIG. 4G plots the vorticity contour for mixer 400, quantifying the decrease in rotational motion along length 430 of mixer 400.

Additional simulations were also conducted using polymeric fluids. In one example, A-isocyanate and B-polyol were used. The two components entered mixers 300 and 400 at a temperature greater than room temperature. The dynamic viscosity was consequently measured using a rotary viscometer. The dynamic viscosity values were found to be A—0.045 Pa·s and B—0.145 Pa·s when A dispersed at 120±3° F. and B at 130°±30° F. CFD simulations quantified the differential pressure between the inlets. Using mixer 400, a pressure differential of 950 PSI was observed, while mixer 300 only reached a differential of 575 PSI. The larger pressure differential allows for mixer 400 to avoid crossover due to user error and/or pump malfunction. Flow rates were also calculated through the simulations with set pressures at the inlets. Mixer 400 experienced 0.147 pounds/second while mixer 300 experienced 0.108 pounds/second.

Experimental testing was also conducted between mixers 300 and 400. At a set pump pressure, gun pressures were compared for each design, using different fluids. For liquid component B, the gun pressure for mixer 400 was 260 PSI greater than that of mixer 300. For liquid component A, the gun pressure was 200 PSI. As illustrated, mixer 400 has a lower back pressure when compared to mixer 300. The lower back pressure allows for a higher flow rate a set pump pressure. This validated the simulated, higher flow rate obtained using the CFD analysis discussed above.

Figure 4H:
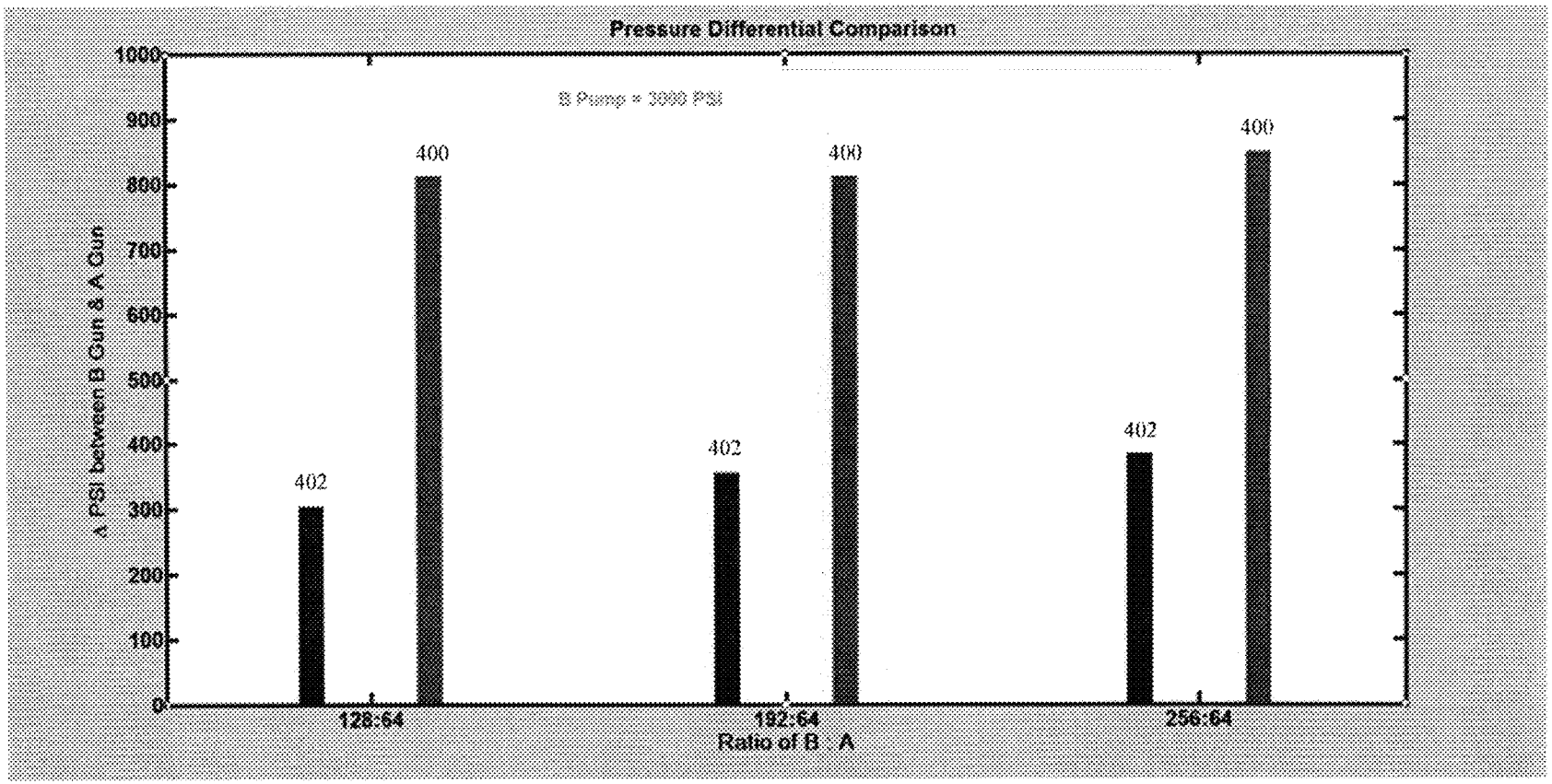

Tests were also conducted to intentionally cause crossover between liquid components for both mixers 300 and 400. The results are illustrated in FIG. 4H as pressure differential values with the spray gun between components A and B for different B to A ratios. Mixer 400 was able to achieve a pressure differential of 841 PSI, while mixer 300 (illustrated in FIGS. 4A-4H as mixer 402) maxed out at 384 PSI.

Additionally, densities of foam sprayed using mixers 300 and 400 were compared, and presented below as Table 1. Foam was sprayed with a 2000 PSI set point, with component A delivered at 120° F. and component B delivered at 130° F. It is noted that the two designs were tested for double pass samples, instead of a single pass with a specification of 46.45 kg/m$^3$. The obtained density values are similar using mixer 400, indicative of similar mixing capabilities.

TABLE 1

| Chamber design | Core Weight (gms) | Core Volume (mL) | Core Density (kg/m$^3$) |
|---|---|---|---|
| Mixer 300 | 6.35 | 110 | 57.82 |
| Mixer 400 | 6.07 | 110 | 55.34 |

The CFD analysis of mixer 300 resulted in crossover at a 560 PSI differential. When testing mixer 400, crossover did not occur until a differential 950 PSI. Therefore, the chance of crossover was reduced by 70%. In a lab setting, crossover could not be induced using mixer 400.

The CFD analysis for the volume fraction demonstrated that mixing within chambers 300 and 400 are similar, with mixer 400 showing slightly improved mixing between components.

The spray pattern and spray atomization has improved when compared to mixer 300 for at least some embodiments. The spray pattern has widened in relation to that obtained using mixer 300. Additionally, as illustrated when comparing FIGS. 3A and 4A, mixer 400 is configured to be installed within similar spray gun configurations.

An additional benefit of mixer 400 is the increased mass flow rate achieved. Mixer 400 was tested using the same inlet size and spray nozzle. CFD results showed that the new design out-performed the current design by 28% with regard to mass flow rate. Higher flow rates allow operators to complete jobs faster, saving operators time and money on each job, and allowing operators to complete more jobs with the same equipment. Mixer 400, and similar embodiments discussed herein, can accomplish this while, maintaining foam density standards and quality.

Figure 5E:
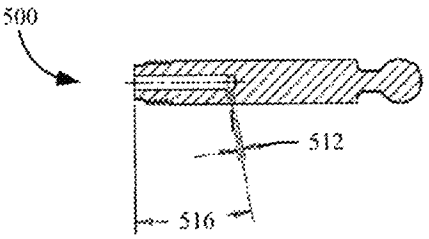
FIGS. 5A-5F illustrate diagrammatic views of a mixer in accordance with an embodiment of the present invention.
Figure 5B:
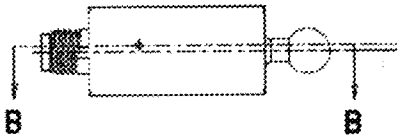
Figure 5A:
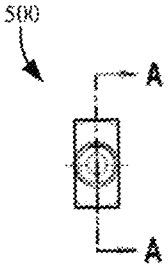
Figure 5D:
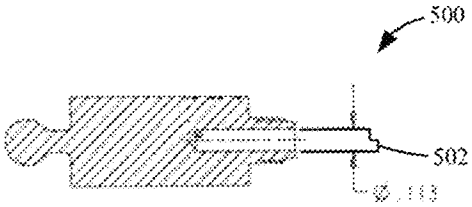
Figure 5C:
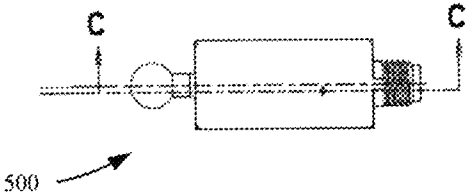
Figure 5F:
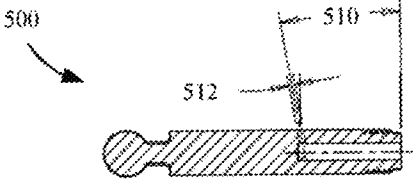

FIGS. 5A-5F illustrate diagrammatic views of a mixer in accordance with an embodiment of the present invention. Mixer 500 is configured to be used in a plural component spray gun. FIG. 5D illustrates a view taken along the cross-section of line A-A, illustrated in FIG. 5A. FIG. 5E illustrates a cross-section of the spray gun taken along line B-B, shown in FIG. 5B. FIG. 5F illustrates a cross-sectional view of the mixer 500 taken along section C-C, shown in FIG. 5C. Mixer 500 is configured to receive two components at inlets on opposing sides of the mixer, as illustrated in FIGS. 5E and 5F. Inlets comprise an offset distance 510, with an orifice angle 512. In one embodiment, as illustrated by mixer 500, both component A and B experience the same offset angle 512 and inlet offset distance 510. However, other embodiments may be constructed differently, for example with the A and B inlets having different offset angles and or different inlet offsets. Mixer 500 has a chamber diameter of 502, of about 0.113 inches, which may allow for a higher volumetric flow rate when compared to previous designs.

Figure 6A:
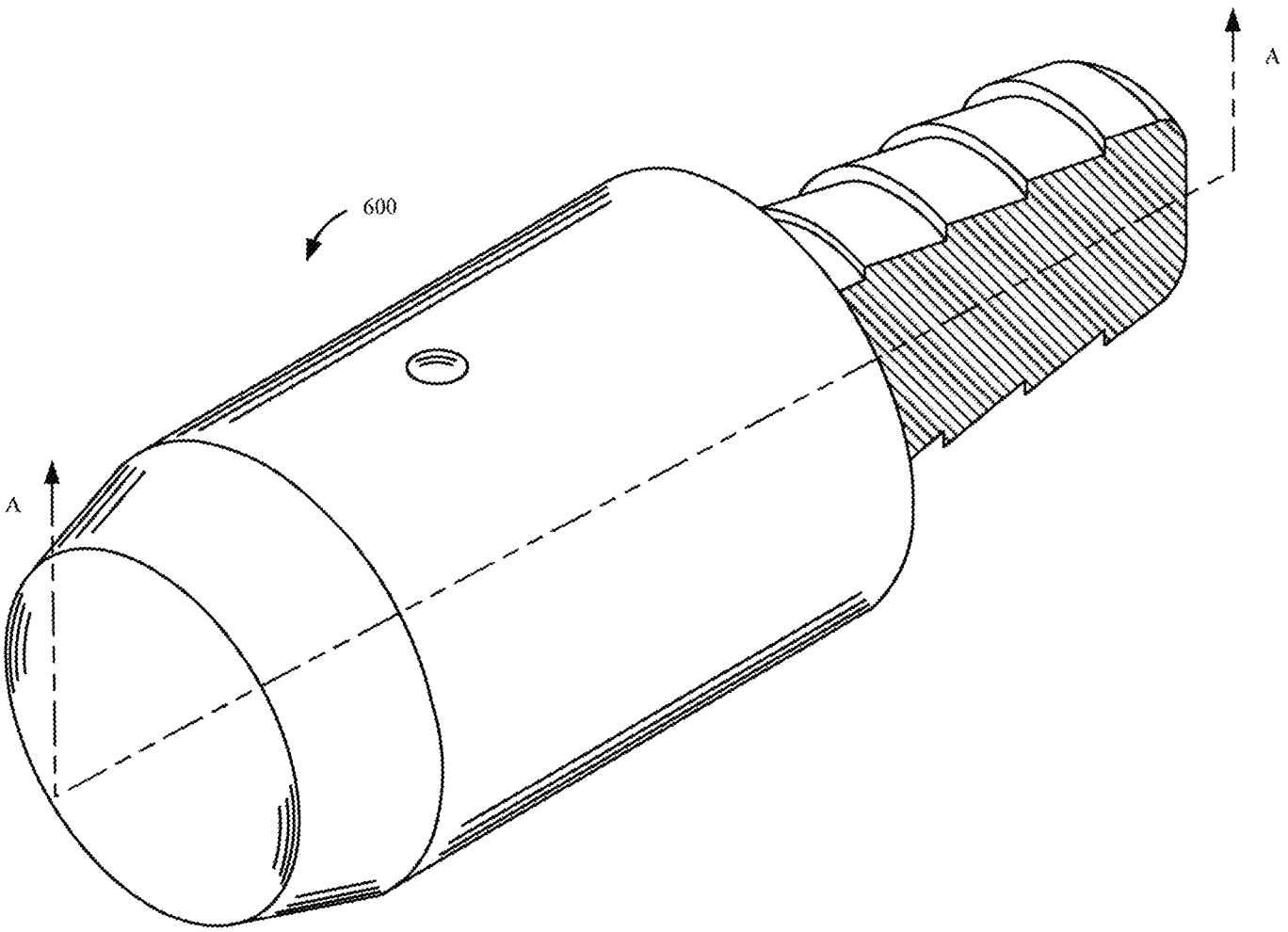
FIGS. 6A-6C illustrate a mixer within a removable spray tip in accordance with an embodiment of the present invention.
Figure 6B:
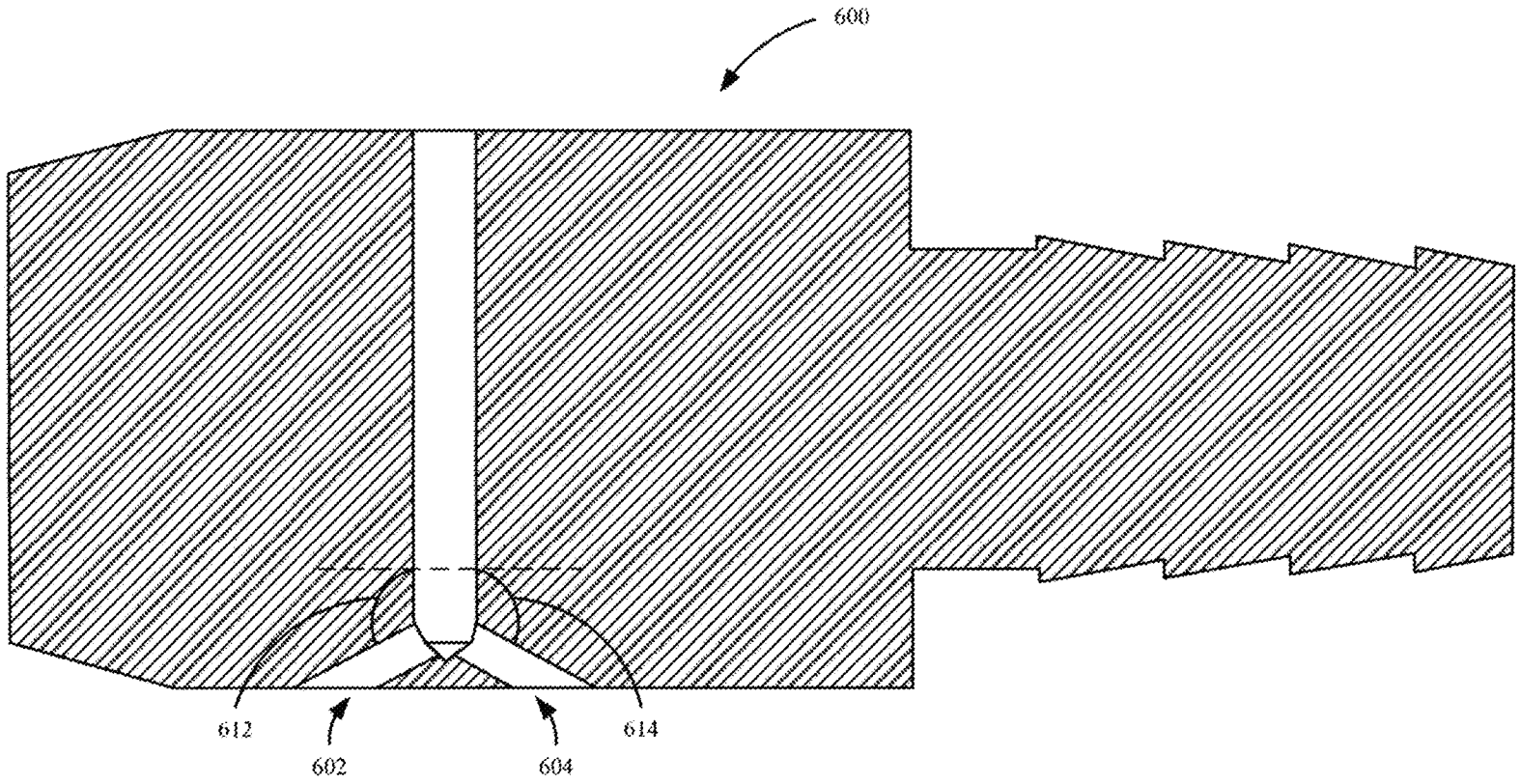
Figure 6C:
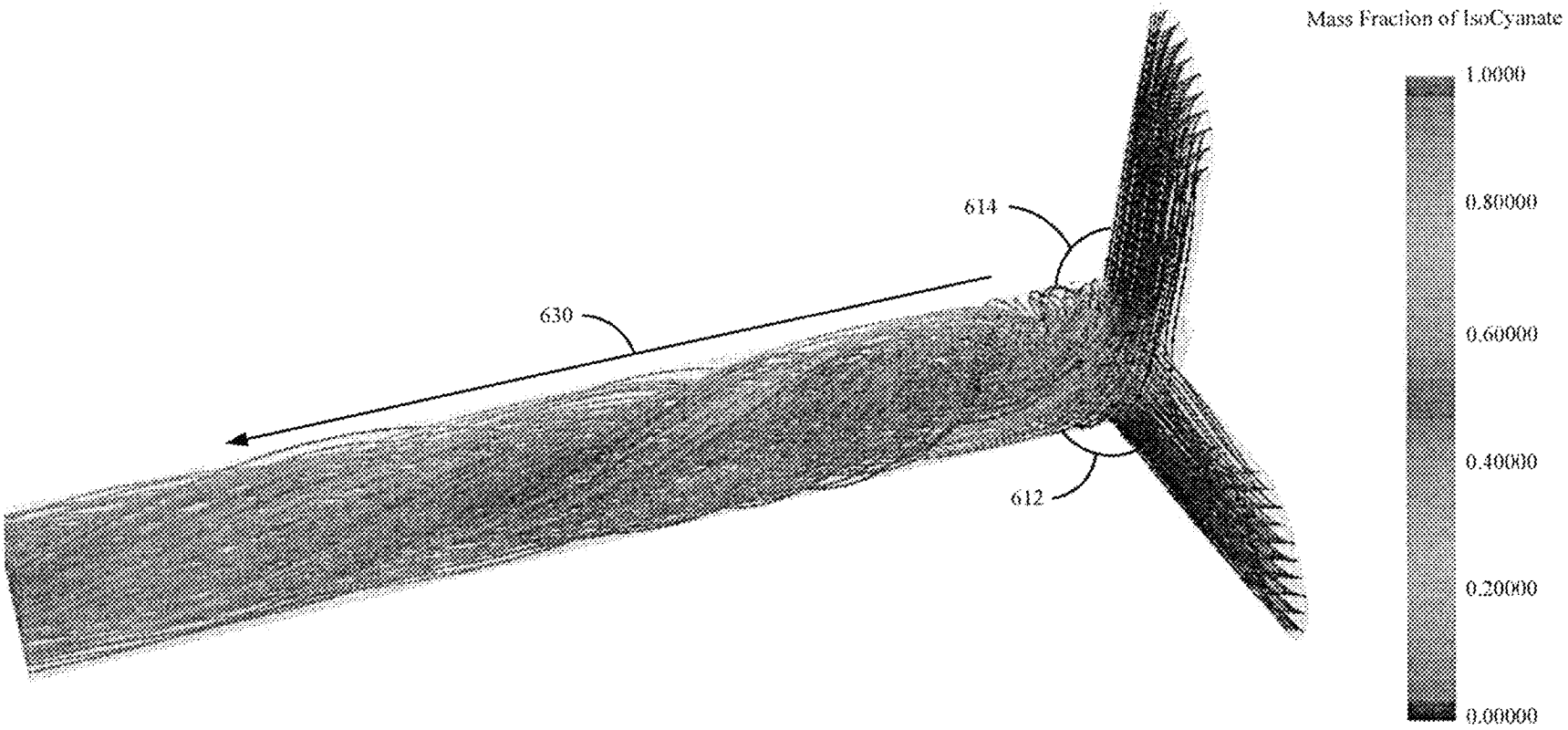

FIGS. 6A-6C illustrate a mixer within a removable spray tip in accordance with an embodiment of the present invention. As illustrated in FIG. 1C, in current designs, a mixer is typically located within a spray gun. In the event crossover occurs, the spray gun must be completely disassembled in order to remove the mixer and address the damage from the crossover event. Additionally, in the event the spray gun is to be used for a different operation, which can require a different mixer configuration, the spray gun must be disassembled and reassembled with the desired mixer configuration between uses. It is desired for a mixer to be more easily removed and replaced from a spray gun design. One embodiment that achieves these goals is illustrated in FIGS. 6A-6C. Spray tip 600 is configured to be inserted within a spray gun, such as spray gun 100, such that fluid flows through the spray tip prior to exiting outlet 150.

FIG. 6B illustrates a cross-sectional view of spray tip 600 taken along line A-A illustrated in FIG. 6A. In one embodiment, the mixer is incorporated into spray tip 600, such that a first liquid component enters through inlet 602 at an inlet offset (not shown), and offset angle 612, while a second component enters through inlet 604, at an inlet offset (not shown) and offset angle 614. The offsets for inlets 602 and 604 may be the same or different. Angles 612 and 614 may be the same or different. In one embodiment, the inlet offset is 0.010 inches, and inlet angles 612 and 614 are each 20° with respect to a centerline of the mixer. However, the offset angle 612 and/or 614, may have a magnitude greater than 20°, for example 21°, 22°, 23°, 24°, 25°, 26°, 27°, or 28°. Additionally, while the inlet offset for 602 and 604 has been described as 0.010, it could also be smaller, for example 0.005 inches, or 0.006 inches, or 0.007 inches, or 0.008 inches, or 0.009 inches. FIG. 6C illustrates volumetric flow through spray tip 600 along flow path 630 to an outlet. As illustrated, complete mixing is achieved between components A and B, along mixer 630 with minimal risk of crossover.

Figure 7A:
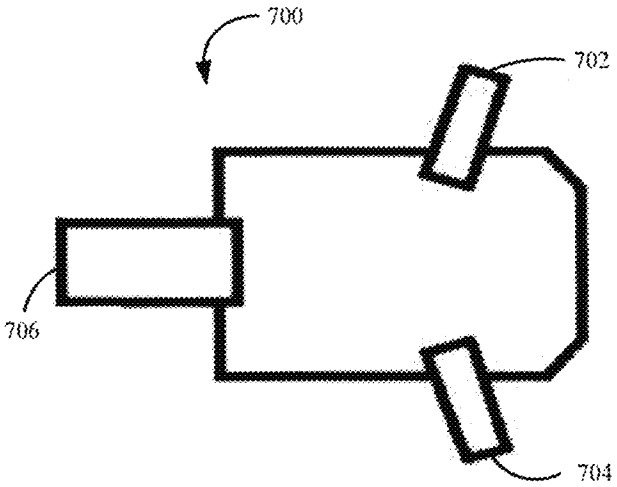
FIGS. 7A-7C illustrate alternative mixer configurations in accordance with some embodiments of the present invention.
Figure 7B:
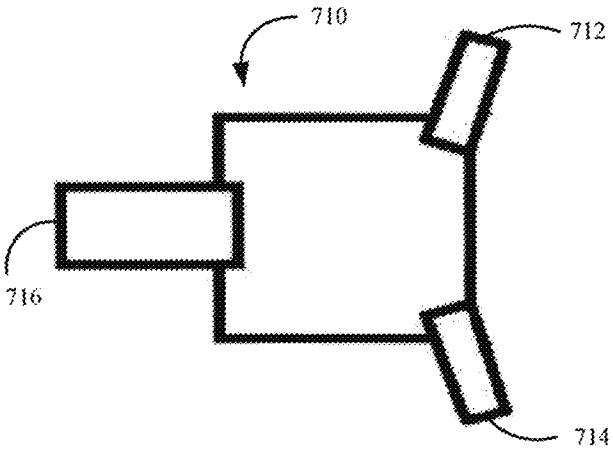
Figure 7C:
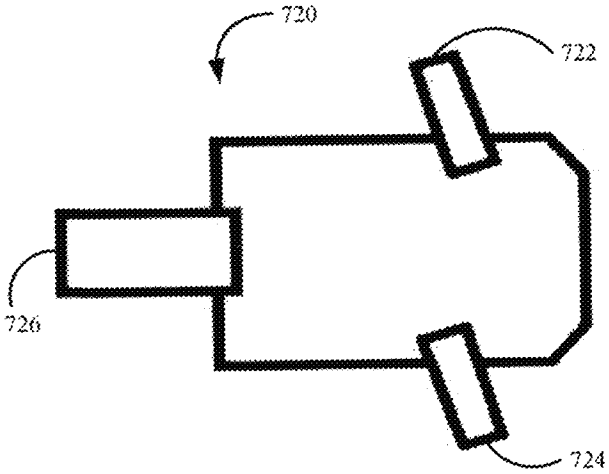

FIGS. 7A-7C illustrate alternative mixer configurations in accordance with some embodiments of the present invention. In FIG. 7A, a mixer 700 comprises an inlet 702 and an inlet 704 configured to allow components to enter a mix chamber 700 and exit through outlet 706. FIG. 7B illustrates an alternative mix chamber design with mix chamber design 710 with inlets 712 and 714 and outlet 716. Additionally, FIG. 7C illustrates a mix chamber 720 with as first inlet 722, a second inlet 724, and an outlet 726.

Although the present invention has been described with reference to preferred embodiments, workers skilled in the art will recognize that changes may be made in form and detail without departing from the spirit and scope of the invention.

What is claimed is:

1. A mixer for a plural component spray gun, the mixer comprising:

a mixer body comprising a mixing chamber having a single outlet and a centerline extending along a length of the mixing chamber;

a first fluid component inlet coupled to a first fluid conduit, the first fluid component inlet configured to introduce a first fluid component into the mixing chamber along a first axis of the first fluid component inlet; and a second fluid component inlet coupled to a second fluid conduit, the second fluid component inlet configured to introduce a second fluid component into the mixing chamber along a second axis of the second fluid component inlet;

wherein the first and second fluid component inlets arc spaced apart and disposed on opposite lateral sides of the mixer body, and the first and second axes are angled relative to a plane perpendicular to the centerline and toward the single outlet, the first and second fluid component inlets are vertically offset from each other with respect to the centerline of the mixing chamber, and the first and second fluid comnonent inlets are positioned such that there is no crossover of the first and second inlets at a pressure differential between 560 pounds per square inch (PSI) and 950 pounds per square inch (PSI).

2. The mixer of claim 1 wherein the mixer body comprises a removable spray tip, wherein the mixing chamber is entirely disposed within the removable spray tip such that the entire mixing chamber is removable with the spray tip.

3. The mixer of claim 1, wherein the centerline comprises a longitudinal axis of the mixing chamber, the single outlet is disposed along the longitudinal axis, the first fluid component inlet is at a first angle with respect to the longitudinal axis of the mixing chamber, and the second fluid component inlet is at a second angle with respect to the centerline of the mixing chamber.

4. The mixer of claim 3, wherein a first magnitude of the first angle is substantially the same as a second magnitude of the second angle.

5. The mixer of claim 4, wherein the first and second angles are substantially mirror images of each other with respect to the centerline of the mixing chamber.

6. The mixer of claim 3, wherein a magnitude of the first angle is different from a magnitude of the second angle.

7. The mixer of claim 3, wherein one of the first and second angles is approximately 10° from 90° with respect to the centerline of the mixing chamber.

8. The mixer of claim 3, wherein one of the first and second angles is approximately 20° from 90° with respect to the centerline of the mixing chamber.

9. The mixer of claim 3, wherein one of the first and second angles is in a range of approximately 10° to approximately 28° from 90° with respect to the centerline of the mixing chamber.

10. The mixer of claim 1, wherein the first inlet has a first vertical offset from the centerline of the mixing chamber, and the second inlet has a second vertical offset from the centerline of the mixing chamber.

11. The mixer of claim 10, wherein one of the first and second vertical offsets is greater than 0.01 inches from the centerline of the mixing chamber.

12. The mixer of claim 10, wherein one of the first and second vertical offsets is at least 0.04 inches from the centerline of the mixing chamber.

13. A mixer for a plural component spray gun, the mixer comprising:

a mixer body comprising a mixing chamber having a single outlet a centerline extending along a length of the mixing chamber;

a first fluid component inlet coupled to a first fluid conduit, the first fluid component inlet configured to introduce a first fluid component into the mixing chamber along a first axis of the first fluid component inlet; and a second fluid component inlet coupled to a second fluid conduit, the second fluid component inlet configured to introduce a second fluid component into the mixing chamber along a second axis of the second fluid component inlet, wherein the first and second fluid component inlets are spaced apart and disposed on opposite lateral sides of the mixer body, and the first and second axes are angled relative to a plane perpendicular to the centerline and toward the single outlet, the first and second fluid component inlets are vertically offset from each other with resect to the centerline of the mixing chamber, wherein the mixing chamber has a diameter greater than 0.112 inches, and wherein one of the first and second fluid component inlets has a diameter of 0.032 inches.

14. A plural component spray gun with a mixing unit, the spray gun comprising:

a spray tip configured to disperse a fluid mixture;

a first component source configured to provide a first component, to a mixing chamber within the mixing unit, at a first process temperature;

a second component source configured to provide a second component, to the mixing chamber within the mixing unit, at a second process temperature; and the mixing chamber comprising:

a single outlet;

a centerline extending along a center axis of a body of the mixing chamber;

a first inlet configured to deliver the first component from the first component source to the mixing chamber along a first axis of the first inlet:

a second inlet configured to deliver the second component from the second component source to the mixing chamber along a second axis of the second inlet; and wherein the first and second inlets are spaced apart and disposed on opposite lateral sides of the mixer body, and the first and second axes are angled relative to a plane perpendicular to the centerline and toward the single outlet, and wherein the first and second inlets are positioned with respect to the centerline such that the first and second inlets are each vertically offset from the centerline at a distance greater than their respective diameters and a diameter of the mixing chamber is greater than the combined diameters of the first and second inlets, and there is no crossover of the first and second inlets at a pressure differential between 560 pounds per square inch (PSI) and 950 pounds per square inch (PSI).

15. The plural component spray gun of claim 14, wherein the angle is in a range of approximately 5° to approximately 10° from 90° with respect to the centerline.

16. The plural component spray gun of claim 14, wherein the angle is in a range of approximately 100 to approximately 200 from 900 with respect to the centerline.

17. The plural component spray gun of claim 14, wherein the angle is in a range of approximately 50 to approximately 250 from 90 with respect to the centerline.

18. The plural component spray gun of claim 14, wherein the spray tip is removably coupled to the spray gun and the mixing chamber is entirely disposed within the removable spray tip of the plural component spray gun such that the first and second components are mixed entirely within the spray tip.

19. The plural component spray gun of claim 14, wherein the mixing chamber is incorporated into a gun block of the plural component spray gun.

* * * * *